US005984760A

United States Patent [19]

Marine

[11] Patent Number: 5,984,760

[45] Date of Patent: Nov. 16, 1999

[54] DOLL HAVING SIMULATED DRINKING ACTION

[75] Inventor: Jon C. Marine, Fullerton, Calif.

[73] Assignee: Mattel, Inc., El Segundo, Calif.

[21] Appl. No.: 09/133,907

[22] Filed: Aug. 13, 1998

[51] Int. Cl.[6] ..... A63H 3/24

[52] U.S. Cl. ..... 446/304; 446/483

[58] Field of Search ..... 446/304, 305, 446/395, 483

[56] References Cited

U.S. PATENT DOCUMENTS

| | | | |
|---|---|---|---|
| D. 217,317 | 4/1970 | Homorodean, Jr. et al. . | |
| 427,927 | 5/1890 | Steiner . | |
| 2,012,060 | 8/1935 | Wittman | 446/304 |
| 2,572,795 | 10/1951 | Wood et al. | 446/305 |
| 2,811,810 | 11/1957 | Ostrander | 446/305 |
| 2,945,321 | 7/1960 | Carter . | |
| 3,005,283 | 10/1961 | Cohn . | |
| 3,016,651 | 1/1962 | Brudney . | |
| 4,504,241 | 3/1985 | Dyson et al. | 446/304 |
| 4,971,048 | 11/1990 | Seekins | 128/202.15 |
| 5,176,561 | 1/1993 | Greenberg et al. | 446/305 |

FOREIGN PATENT DOCUMENTS

| | | | |
|---|---|---|---|
| 432650 | 10/1911 | France . | |
| 785020 | 7/1935 | France | 446/304 |
| 405500 | 1/1923 | Germany . | |

OTHER PUBLICATIONS

"Bebe3s Teteurs, Par M. Bru", Article de Paris et Petites Industries (FR 132998).

*Primary Examiner*—Robert A. Hafer
*Assistant Examiner*—Jeffrey D. Carlson
*Attorney, Agent, or Firm*—Roy A. Ekstrand

[57] ABSTRACT

A bottle includes an outer vessel formed of a transparent or clear material and an inner vessel slightly smaller than the outer vessel and received therein to create a space therebetween. A cap is secured to the outer vessel and defines apertures therein. The outer vessel defines a closed upper end having apertures aligned with the cap apertures. A valve body providing check valves operable in opposite directions is coupled to a pair of straws which in turn are directed upwardly through the respective apertures and are joined at a common pump bulb. The pump bulb is formed of a resilient elastic material and cooperates with the check valves to displace liquid from the outer vessel to the inner vessel as the bulb is repeatedly squeezed and released. A doll cooperating with the bottle receives the pump bulb in a mouth opening and provides mouth motion to squeeze and release the pump bulb.

8 Claims, 2 Drawing Sheets

10
11
12
13
14
15
20
21
22
23
24
25
30
31
32
33
34
35
36
40
41
50
51
53
55
60
61
62
63
64
65
66
67
68
70
71
72
73
74
75
76
77
78
80
81
82
90
91
92
93
94
95
96
100
101
102
103
104
105
106
115
116
117

DOLL HAVING SIMULATED DRINKING ACTION

FIELD OF THE INVENTION

This invention relates generally to dolls and particularly to those which provide simulated liquid drinking action.

BACKGROUND OF THE INVENTION

A variety of dolls have been provided by practitioners in the art which relate to simulated eating and drinking and which perform these simulations to varying degrees of realism. Drinking dolls in particular have enjoyed substantial development and attention by practitioners. As a result, drinking dolls have been provided in various designs and themes. However, all generally utilize a mouth aperture and, in some instances, moving lips together with a tube conducting liquid from the mouth aperture to an interior reservoir within the doll abdomen. Typically a baby bottle having a nipple suitable for insertion in a fitting attachment to the doll mouth aperture is provided. Often sound circuits are provided in which the doll responds to the administering of liquid by the user with contended sounds and/or cries in the absence of such. In most such drinking dolls, a liquid is ingested into the doll body and is collected within a reservoir. In some, this collected liquid is released through the lower torso to simulate wetting while in others the retained liquid must be emptied by the user. The retained liquid in such dolls often creates a messy situation due to the requirement that an emptying tube, valve, and port must be provided. In addition, the need to continuously empty the interior bladder detracts from the realism of the doll since this is an unnatural activity. Also such dolls very often utilize a very large volume internal bladder or reservoir which detracts from the realism of the doll as liquid churns within the reservoir interior.

U.S. Pat. No. 3,005,283 issued to Cohn sets forth a LIP MOVING MECHANISM FOR A DOLL OR THE LIKE having a resilient doll head and face joined to a doll torso. Within the doll head an internal aperture is formed and an apparatus is operative upon the mouth to cause it to open and close simulating lip movement. A tube leads from the doll mouth to a reservoir within the torso of the doll. A nipple and bottle is inserted into the mouth aperture and the lip movement adds realism to the activity.

U.S. Pat. No. 3,016,651 issued to Brudney sets forth a DOLL MOUTH having a doll head supporting a position actuated mouth valve which receives a feeding bottle. At one position of the doll, the mouth valve is closed while at an alternate position the mouth valve is open facilitating the ingestion of liquid.

U.S. Pat. No. 2,945,321 issued to Carter sets forth an IMITATIVE NURSING DOLL having a doll supporting a pivotable arm and a hand thereon for securing a nursing bottle. The hand and arm are pivotally supported to facilitate positioning the nipple of the nursing bottle within the doll's mouth.

U.S. Pat. No. 427,927 issued to Steiner sets forth a DOLL having a mouth aperture coupled to a passage extending through the doll head and exiting at the back of the neck. A tube is coupled through the passage and is secured to the straw of a liquid bottle. The remaining end of the tube exits downwardly and terminates in a reservoir supported beneath the seat of the doll.

Still other patents show various related structures. For example, U.S. Pat. No. 4,971,048 issued to Seekins sets forth a DUAL VALVE LIQUID TRANSFER TUBE FOR USE IN COMBINATION WITH A PROTECTIVE MASK while DES. U.S. Pat. No. 217,317 issued to Homorodean, Jr. et al sets forth a MULTIPLY SPIRALLED CURVED DRINKING STRAW. In addition, German Patent 405,500 sets forth a MULTIPLY FEATURED DOLL INCLUDING AN ASSOCIATED NURSING BOTTLE while French Patent 432,650 sets forth a DRINKING DOLL having an interior reservoir within the doll torso and a tube leading therefrom upwardly to a mouth aperture. The tube includes a vertical portion to confine liquid ingestion to the circumstances in which the doll is substantially horizontal.

While the foregoing described prior art devices have provided some improvement in the art, and have in some instances enjoyed commercial success, they remain subject to various limitations including the difficulty of retaining a large liquid mass within the doll. In addition, such prior art devices often fail to achieve sufficient realism or maximizing the enjoyment by young children. In further addition, the need for emptying internal liquid reservoirs in many of the prior art dolls further limits the attractiveness of the toy.

SUMMARY OF THE INVENTION

Accordingly, it is a general object of the present invention to provide an improved doll having simulated drinking action. It is a more particular object of the present invention to provide an improved doll which realistically simulates drinking action and which avoids the need for ingesting liquid in achieving this realistic drinking action.

In accordance with the present invention, there is provided a doll and beverage bottle in combination comprising: a doll having a head, face, lips and mouth, motor means within the doll head for moving the mouth and the lips closer together and farther apart, a beverage bottle having an outer vessel defining a first interior and an inner vessel, smaller than the outer vessel, received within the first interior and defining a second interior, a space being defined between the outer vessel and the inner vessel, switch means for controlling the motor means, first and second liquid-carrying hollow tubes each having an upper end and a lower end, the lower ends inserted into the second interior, a pump bulb formed of an elastic resilient material sized and shaped to be at least partially insertable into the mouth and defining a chamber, the pump bulb chamber being coupled to the upper ends of the first and second hollow tube, and a valve body having a first passage and a first check valve for transferring liquid from the space to the lower end of the first tube and a second passage and a second check valve for transferring liquid from the lower end of the second tube to the second interior, the pump bulb being inserted into the mouth and the motor means repeatedly squeezing the pump bulb to transfer liquid from the space to the second interior.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, and in which:

DESCRIPTION OF THE PREFERRED EMBODIMENTS

Figures 1, 2:
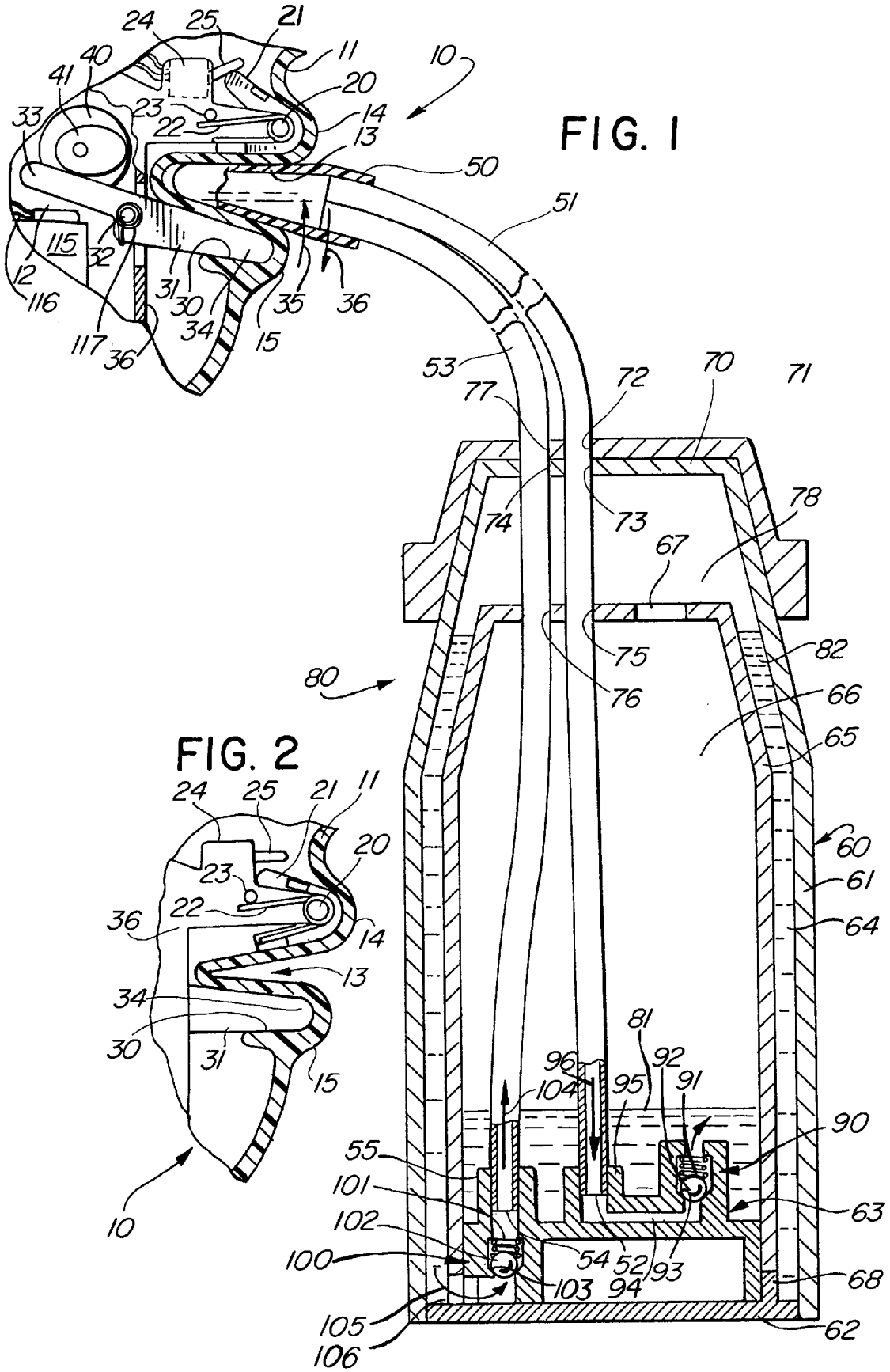
FIG. 1 sets forth a partial section view of a doll having simulated drinking action constructed in accordance with the present invention together with an associated liquid drinking apparatus.
FIG. 2 sets forth a partial section view of the lip portion of the present invention doll.

FIG. 1 sets forth a partial section view of a doll having simulated drinking action constructed in accordance with the present invention and generally referenced by numeral 10. Doll 10 includes a head 11 preferably formed of a resilient flexible material such as molded plastic or the like. Head 11 defines an interior cavity 12 and a pair of lips 14 and 15 on either side of a mouth 13. In the preferred embodiment of the present invention, mouth 13 is a closed end receptacle having a generally tapered shape. Doll 10 further includes a support frame 36 within head 11 of doll 10 which further defines a post 20. Post 20 supports a generally U-shaped switch lever 21 in pivotal attachment against the upper surface of mouth 13. A spring 22 and post 23 cooperate to urge switch lever 21 in a counterclockwise direction forcing the lower end of switch lever 21 against the upper surface of mouth 13 and causing it to be collapsed to the empty position shown in FIG. 2 in the absence of an inserted article. A switch 24 is supported upon frame 36 and includes a toggle 25 for operating switch 24. Toggle 25 extends outwardly and contacts switch lever 21 at its upper end.

Frame 36 further supports a motor 40 having an eccentric cam 41 rotated thereby. A pivot 32 secures a lever 31 having an end 33. Cam 41 is operative upon end 33 during rotation of the cam to instill angular movement about pivot 32. Head 11 further defines a recess 30 beneath lip 15 which receives end 34 of lever 31. Thus as cam 41 rotates and moves lever end 33 about pivot 32, lever end 34 moves lip 15 in a corresponding but opposite direction motion.

In further accordance with the present invention, a bottle 80 is provided for operation in combination with doll 10. Bottle 80 includes an outer vessel 60 (preferably formed of a clear or transparent material) having a base 62 secured to the bottom thereof. Outer vessel 60 further defines a closed upper end 70 defining a pair of apertures 73 and 74. A cap 71 having apertures 72 and 77 respectively aligned with apertures 73 and 74 is formed in cap 71. Cap 71 is secured to the upper end of outer vessel 60 using conventional adhesive attachment or other conventional forms of attachment such as sonic or thermal welding. Outer vessel 60 defines an interior space 78.

Bottle 80 further includes an inner vessel 65 configured to be received within interior 78 of outer vessel 60 and sufficiently smaller in size to define a space 64 between inner vessel 65 and outer vessel 60. Inner vessel 65 defines a refill aperture 67 on the upper face thereof together with apertures 75 and 76. Apertures 75 and 76 are generally aligned with apertures 73 and 74. A liquid volume 82 is captivated between inner vessel 65 and outer vessel 60 and thus occupies space 64 therebetween.

A valve body 63 is received within base 52 and secured by an annular seal rim 68. Valve body 63 is sealingly attached to base 62 which in turn is sealingly attached to the lower end of outer vessel 60 completing the sealed structure of bottle 80. Valve body 63 supports a check valve 90 having a valve seat 93 receiving a ball 92 together with a valve spring 91. Valve body 63 further defines a passage 94 coupling check valve 90 to a fitting 95.

Valve body 63 further defines a check valve 100 having a valve seat 103 receiving a ball 102. A spring 101 is operative upon ball 102. Check valve 100 is coupled to a fitting 55. A passage 106 is formed by apertures in the lower end of inner vessel 65 and valve body 63 communicating space 64 with check valve 100.

A resilient pump bulb preferably formed of a resilient elastic material such as plastic or rubber is generally tapered in shape and receivable within mouth 13 by a forced insertion. Pump bulb 50 is hollow and is sealingly joined to a pair of flexible tubular straws 51 and 53. Straws 51 and 53 define respective ends 52 and 54. Straw 51 passes outwardly from pump bulb 50 through aperture 72 of cap 71, aperture 73 of outer vessel 60, and aperture 75 of inner vessel 65. End 52 of straw 51 is received within fitting 95 in a liquid-type insertion attachment. If desired, an adhesive may additionally be used to secure end 52.

Similarly, straw 53 extends outwardly from pump bulb 50 and passes through apertures 77, 74, and 76 to be received within fitting 55 of valve body 63. Once again a forced fit attachment is generally sufficient, however, end 54 may be otherwise attached using an adhesive attachment or the like.

Pump bulb 50 is formed of a sufficiently resilient material and is sized to fit within mouth 13 in a tight force fit attachment sufficient to pivot switch lever 21 to the position shown in FIG. 1. In this position of pivotal movement about post 20, switch lever 21 contacts and actuates toggle 25 turning on switch 24. By conventional means not shown, switch 24 is operatively coupled to motor 40 and an internal battery power supply 115 having a connection wire set 116. Thus while the entirety of connections between switch 24, motor 40, and battery supply 115 is not shown in FIG. 1, it will be understood that switch 24 is operative to control the application of battery power from battery 115 to motor 40 using conventional fabrication techniques.

Once motor 40 is energized due to the insertion of pump bulb 50 into mouth 13 and the cooperation of switch lever 21 and switch toggle 25, eccentric cam 41 is rotated in the clockwise direction causing oscillatory pivoting motion of end 33 of lever 31. A corresponding opposite direction motion is imparted to lip 15 by end 34 of lever 31. Thus when cam 41 locates the maximum eccentric of the cam against end 33 of lever 31, lever 31 pivots to drive end 34 and thereby lip 15 upwardly in the direction indicated by arrow 35. This upward motion of end 34 and lip 15 squeezes pump bulb 50 expelling the contents therefrom under pressure. Conversely, with cam 41 rotated away from its maximum eccentricity, a return spring 117 urges lever 31 in a clockwise rotational direction maintaining end 33 against cam 41 and pivoting end 34 of lever 31 downwardly in the direction indicated by arrow 36. The downward motion of end 34 separates lip 15 from lip 14 and releases the force against pump bulb 50.

Pump bulb 50, being formed of a resilient material such as plastic or rubber, responds to the squeezing operation of doll 10 by expelling the contents therefrom and responds to release of squeezing pressure by expanding to return to its original shape. Thus as motor 40 is activated and cam 41 is rotated, pump bulb 50 is alternatively squeezed and released in a succession of short term mouth motions intended to simulate those of a child drinking a liquid beverage.

When pump bulb 50 is squeezed as lip 15 is driven upwardly in the direction indicated by arrow 35, the liquid within pump bulb 50 and straws 51 and 53 is forced outwardly through ends 52 and 54. However, check valve 100 closes in response to this pressure and the liquid within straw 53 does not move to any substantial extent. Conversely, the pressure driven liquid within straw 51 flows outwardly from end 52 thereof through passage 94 to check valve 90. The force of liquid within passage 94 opens check valve 90 allowing liquid to be moved past check valve 90 into the accumulated liquid quantity 81 within interior 66 of inner vessel 65. In the absence of pressure, check valve 90 closes due to spring 91 trapping the displaced liquid within quantity 81. When mouth 13 opens, pump bulb 50 having been squeezed and deformed during the previous compression stroke expanding and returning to its normal shape. As pump bulb 50 expands toward its normal shape in the absence of mouth pressure, liquid within straws 51 and 53 is drawn upwardly to fill the volume of pump bulb 50. The upward draw of liquid within straw 53 produces a partial vacuum against check valve 100 opening the check valve and allowing liquid to flow through passage 106 from space 64. This flow is indicated by arrow 105 and arrow 104. Conversely, the partial vacuum applied to straw 51 exerts a partial vacuum against check valve 90 drawing ball 92 against seat 93 and further closing communication through the check valve. As a result, no liquid flows through straw 51 during the relaxation or expansion portion of pump bulb 50. In this manner, each time pump bulb 50 is released and allowed to expand, a quantity of liquid is drawn upwardly through straw 53.

By repetitive motions of squeezing and release in the directions indicated by the arrows 35 and 36 of mouth 13 applied to pump bulb 50, liquid is transferred from space 64 into interior 66. It should be noted that because interior 66 is substantially greater in volume, the appearance given the user as liquid 82 within space 64 is transferred to interior 66 to accumulate as liquid 81 simulates the decreasing level of liquid volume as the liquid level of liquid 82 drops. Once a sufficient quantity of liquid 82 has been transferred to collect within liquid quantity 81 and the level of liquid within space 64 has dropped, the operative cycle may be repeated in which liquid is transferred from interior 66 to space 64 by simply inverting bottle 80. With bottle 80 inverted, liquid 81 flows outwardly from interior 66 through a refill aperture 67. When bottle 80 is again returned to its upright position, a substantial quantity of liquid is captivated within space 64 again providing a full container appearance.

In operation, the child user inserts pump bulb 50 into mouth 13 with sufficient force to drive the upper surface of mouth 13 against switch lever 21 and to secure pump bulb 50 within the doll's mouth. Thereafter, the switching action of switch 24 using toggle 25 and switch lever 21 energized motor 40 and the action of lever 31 and cam 41 causes lips 14 and 15 to move together and apart in a simulated lip suction motion. The repeated compressing and relaxing of pump bulb 50 causes the transfer of liquid from space 64 to interior 66 by virtue of the above-described operation.

FIG. 2 sets forth a partial section view of the mouth portion of doll 10 in the relaxed state and in the absence of pump bulb 50. Doll 10 includes a head 11 preferably formed of a resilient material such as molded plastic or the like which defines a mouth 13 together with lips 14 and 15 therein. A frame 36 supports a switch 24 having a toggle 25 and a post 20 within doll head 11. By means set forth above, a lever 31 includes an end 34 received within a recess 30 formed within lip 15. A generally U-shaped switch lever 21 is pivotally secured to post 20 and rests against the upper surface of mouth 13 due to a return spring 22 also secured to post 20. Spring 22 is confined by a post 23 formed on frame 36 and operates to provide a spring force which urges switch lever 21 in the counterclockwise direction.

Of importance with respect to the present invention, FIG. 2 shows the relaxed position of mouth 13 in the absence of an inserted pump bulb such as pump bulb 50 shown in FIG. 1. Thus it should be noted with mouth 13 generally empty, spring 22 pivots switch lever 21 in a counterclockwise direction releasing toggle 25 of switch 24. In this configuration, switch 24 is open circuited and the above-described motor driven manipulation of lip 15 is terminated. Comparison of FIGS. 1 and 2 shows the action by which the lip motion activity is initiated as pump bulb 50 is forced into mouth 13 with sufficient force to overcome spring 22 and pivot switch lever 21 upwardly to displace toggle 25 and activate switch 24. A converse reaction takes place in going from the operative position of FIG. 1 to the relaxed position of FIG. 2 in which withdrawing pump bulb 50 from mouth 13 allows spring 22 to pivot switch lever 21 in a counterclockwise direction releasing toggle 25.

Figure 3:
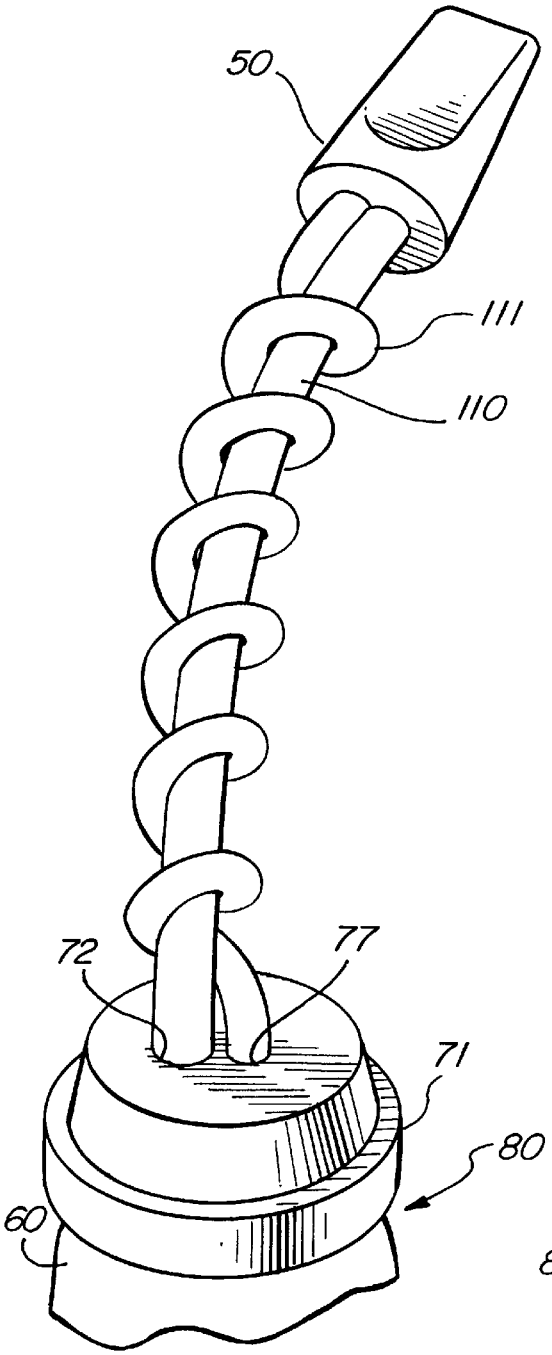
FIG. 3 sets forth a partial perspective view of the drinking straw and pump apparatus of the present invention.

FIG. 3 sets forth a partial perspective view of an alternate embodiment of the present invention. Outer vessel 60 and cap 71 are secured to bottle 80 which function in the manner set forth below in FIG. 1. The difference in the embodiment of FIG. 3 is found in the tubes extending through apertures 72 and 77 of cap 71. In the embodiment of FIG. 3, tube 110 passes through aperture 72 of cap 71 and extends to a pump bulb 50. A helical tube 111 extends upwardly through aperture 77 of cap 71 and winds about tube 110 and ultimately is received within pump bulb 50. The sole difference between the embodiment of FIG. 3 and the embodiment of FIG. 1 is found in the use of a generally direct tube 110 and a helical tube 111. It has been found that forming tubes 110 and 111 of a clear material allowing the user to view liquid travel adds further amusement and enjoyment to observing the present invention device.

Figure 4:
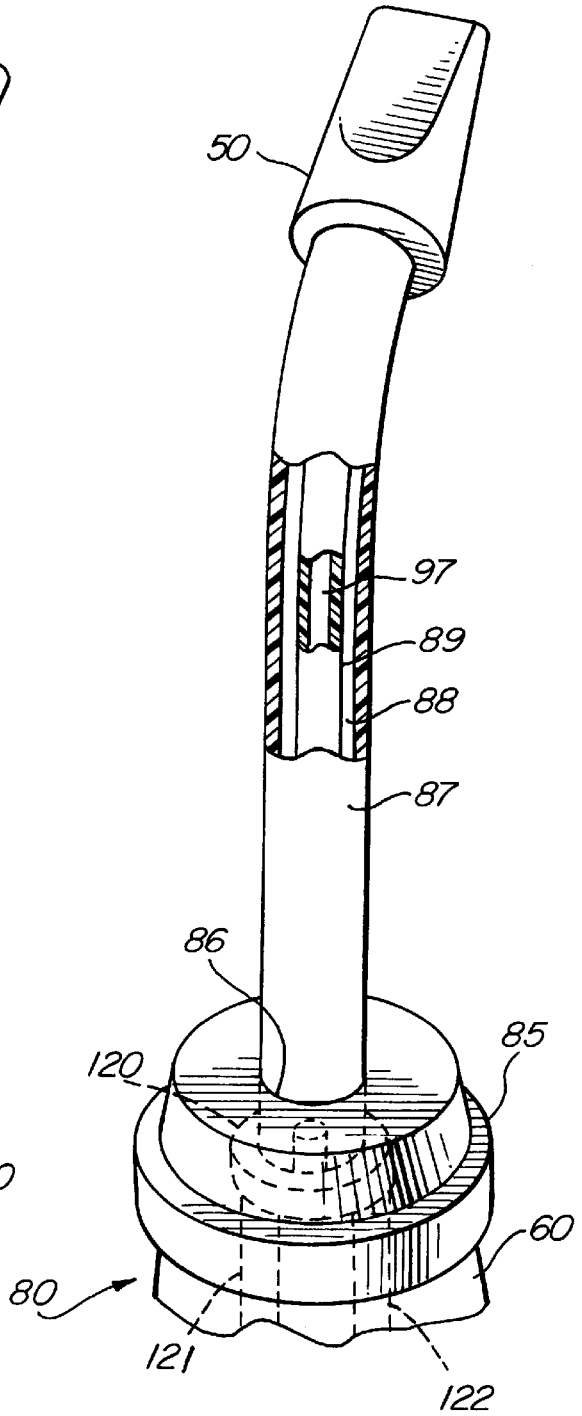
FIG. 4 sets forth a perspective view of an alternate embodiment of the present invention utilizing coaxial tubes in place of a straw.

FIG. 4 sets forth a partial perspective view of a still further alternate embodiment of the present invention. The embodiment of FIG. 4 differs from the embodiments of FIGS. 1 and 3 through its use of a set of coaxial tubes coupled between pump bulb 50 and bottle 80. In all other respects, the operation of pump bulb 50 and bottle 80 is identical to that set forth below in FIG. 1. Accordingly, bottle 80 includes an outer vessel 60 supporting a cap 85. Cap 85 defines an aperture 86 therein. An outer tube 87 having an interior passage 88 is sealingly secured to pump bulb 50 at its upper end and is passed downwardly through aperture 86 of cap 85. An inner tube 89 having a passage 97 formed therein is received within passage 88 of outer tube 87 and extends upwardly into pump bulb 50.

A manifold 120 constructed in accordance with conventional fabrication techniques is coupled to the lower ends of tubes 87 and 89. Manifold 120 is fabricated in accordance with conventional fabrication techniques used in coaxial tubing apparatus and provides independent passages for each of tubes 87 and 89 which are coupled individually to outputs 121 and 122. Outputs 121 and 122 are coupled to fittings 95 and 55, respectively (shown in FIG. 1), thus the operation of pump bulb 50 and bottle 80 together with manifold 120 causes liquid flow in opposite directions through passages 88 and 97. As a result, outer tube 87 and inner tube 89 perform as equivalents of separate straws 51 and 53 in the manner described above.

What has been shown is a doll having simulated drinking action which utilizes a container bottle having an outer vessel and inner vessel for raising and lowering a contained liquid volume to give the appearance of change of liquid contents. The doll utilizes a mouth moving mechanism operative upon an elastic pump bulb secured within the doll's mouth. The appearance of the doll and the liquid bottle combine to replicate ingestion of a liquid by the doll while avoiding the transfer of any liquid into the doll.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll and beverage bottle in combination comprising:

a doll having a head, face, lips, and mouth;

motor means within said doll head for moving said mouth and said lips closer together and farther apart;

a beverage bottle having an outer vessel defining a first interior and an inner vessel, smaller than said outer vessel, received within said first interior and defining a second interior, a space being defined between said outer vessel and said inner vessel;

switch means for controlling said motor means;

first and second liquid-carrying hollow tubes each having an upper end and a lower end, said lower ends inserted into said second interior;

a pump bulb formed of an elastic resilient material sized and shaped to be at least partially insertable into said mouth and defining a chamber, said pump bulb chamber being coupled to said upper ends of said first and second hollow tube; and a valve body having a first passage and a first check valve for transferring liquid from said space to said lower end of said first tube and a second passage and a second check valve for transferring liquid from said lower end of said second tube to said second interior, said pump bulb being inserted into said mouth and said motor means repeatedly squeezing said pump bulb to transfer liquid from said space to said second interior.

2. The combination set forth in claim 1 wherein said mouth is formed of a resilient material and, in a relaxed state, defines a recess smaller than said inserted portion of said pump bulb and wherein said switch means are actuated by the forced insertion of said pump bulb portion.

3. The combination set forth in claim 2 wherein said inner vessel defines an upper portion having refill aperture formed therein which communicates said first and second interiors.

4. The combination set forth in claim 3 wherein said motor means includes:

a lever having a first end secured to one of said lips, a second end and pivot therebetween;

a motor, coupled to said switch, having an eccentric cam rotated by said motor against said second end of said lever.

5. The combination set forth in claim 4 wherein said first and second hollow tubes are arranged in a substantially side-by-side relationship.

6. The combination set forth in claim 4 wherein said first and second hollow tubes are coaxial.

7. The combination set forth in claim 4 wherein one of said hollow tubes is helically wound around the other.

8. A doll and beverage bottle in combination comprising:

a bottle defining an inner reservoir and a surrounding space defining an outer reservoir;

a pair of straws having lower ends inserted into said bottle and upper ends;

a resilient pump bulb receiving said upper ends deformable to force a liquid into said straws;

a pair of oppositely oriented check valves each coupled to one of said lower ends; and a doll having a mouth for receiving a portion of said pump bulb and motor means for squeezing and relaxing said pump bulb, whereby said doll mouth repetitively squeezes and relaxes said pump bulb and said check valves direct liquid flow from said surrounding space to said inner reservoir to give the appearance of the doll consuming the liquid.

* * * * *